US006935215B2

(12) United States Patent
Lindee et al.

(10) Patent No.: US 6,935,215 B2
(45) Date of Patent: Aug. 30, 2005

(54) SLICING MACHINE AND CONVEYOR SYSTEM WITH AUTOMATIC PRODUCT WIDTH COMPENSATION

(75) Inventors: Scott A. Lindee, Mokena, IL (US); Glenn Sandberg, Lockport, IL (US)

(73) Assignee: Formax, Inc., Mokena, IL (US)

( * ) Notice: Subject to any disclaimer, the term of this patent is extended or adjusted under 35 U.S.C. 154(b) by 124 days.

(21) Appl. No.: 10/218,967

(22) Filed: Aug. 14, 2002

(65) Prior Publication Data

US 2004/0031363 A1 Feb. 19, 2004

(51) Int. Cl.[7] ..... B26D 5/00; B26D 7/06

(52) U.S. Cl. ..... 83/74; 83/155; 83/412; 83/444; 83/446; 83/448; 83/932

(58) Field of Search ..... 83/412, 409, 932, 83/444, 446, 448, 77, 74, 75, 155

(56) References Cited

U.S. PATENT DOCUMENTS

| | | | | |
|---|---|---|---|---|
| 1,807,313 A | * | 5/1931 | Hines | 83/77 |
| 3,905,259 A | | 9/1975 | Spooner | |
| 3,948,153 A | | 4/1976 | Dutro et al. | |
| 3,965,783 A | | 6/1976 | Müller et al. | |
| 4,015,494 A | * | 4/1977 | Spooner et al. | 83/77 |
| 4,018,326 A | | 4/1977 | Hardy | |
| 4,135,616 A | | 1/1979 | Pellaton | |
| 4,196,646 A | | 4/1980 | Mukumoto | |
| 4,217,650 A | | 8/1980 | Kuchler | |
| 4,312,252 A | * | 1/1982 | Duddridge | 83/80 |
| 4,379,416 A | | 4/1983 | Kuchler | |
| 4,405,186 A | * | 9/1983 | Sandberg et al. | 83/77 |
| 4,428,263 A | | 1/1984 | Lindee et al. | |
| 4,548,108 A | * | 10/1985 | Dennis | 83/77 |
| 4,583,435 A | * | 4/1986 | Fessler | 83/409 |
| 4,598,618 A | | 7/1986 | Kuchler | |
| 4,684,008 A | | 8/1987 | Hayashi et al. | |
| 4,793,228 A | | 12/1988 | Etter et al. | |
| 4,913,019 A | * | 4/1990 | Hayashi | 83/437.1 |
| 4,941,375 A | * | 7/1990 | Kasper | 83/77 |
| 4,962,568 A | | 10/1990 | Rudy et al. | |
| 5,125,303 A | | 6/1992 | Hoyland | |

(Continued)

FOREIGN PATENT DOCUMENTS

| | | |
|---|---|---|
| DE | 326514 | 9/1920 |
| DE | 386 794 | 12/1923 |
| DE | 28 20 618 | 12/1978 |
| EP | 0 634 325 B1 | 1/1995 |
| WO | WO 00/59689 | 10/2000 |
| WO | WO 00/59690 | 10/2000 |
| WO | WO 03/024675 A1 | 3/2003 |

*Primary Examiner*—Allan N. Shoap
*Assistant Examiner*—Jason Prone
(74) *Attorney, Agent, or Firm*—The Law Office of Randall T. Erickson, P.C.

(57) ABSTRACT

The invention provides a slicing and conveying system that includes a slicing blade that cuts slices from a loaf, and an output conveyor located below the slicing blade for receiving the slices in a draft. A control system automatically adjusts a lateral movement of the output conveyor to form a laterally shingled draft of a consistent width in response to a sensed lateral dimension of the loaf being sliced. The control system includes a displacement sensor carried by a laterally adjustable guide assembly adjacent to the slicing blade. The displacement sensor is signal-connected to a control. The control is signal-connected to the output conveyor to control the lateral movement of the output conveyor according to the lateral dimension of the loaf sensed by the displacement sensor. As an additional aspect, the slices can be shingled in the longitudinal direction to form a two dimensional footprint. A length sensor can sense the length of the shingled draft and send a feedback signal to the control to make adjustments to the longitudinal movement of the output conveyor to adjust the degree of longitudinal shingling.

27 Claims, 3 Drawing Sheets

U.S. PATENT DOCUMENTS 5,168,978 A 12/1992 Cox et al.
5,423,250 A 6/1995 Anderson et al.
5,481,466 A 1/1996 Carey
5,649,463 A 7/1997 Lindee et al.
5,697,275 A * 12/1997 Lindee et al. ..... 83/446
5,974,925 A 11/1999 Lindee et al.
6,318,224 B1 * 11/2001 Hoyland ..... 83/932
6,502,490 B1 * 1/2003 Krawick ..... 83/932
2003/0145700 A1 * 8/2003 Lindee ..... 83/78
2003/0221528 A1 * 12/2003 Sandberg et al. ..... 83/932

* cited by examiner

SLICING MACHINE AND CONVEYOR SYSTEM WITH AUTOMATIC PRODUCT WIDTH COMPENSATION

TECHNICAL FIELD OF THE INVENTION

The invention relates to slicing and conveying systems that include a laterally displaceable receiving surface to arrange slices in a laterally shingled arrangement.

BACKGROUND OF THE INVENTION

It is known to slice a loaf with a blade wherein slices are dropped to a moving output conveyor located below the blade such that slices can be shingled in the longitudinal direction. Such an arrangement is disclosed in U.S. Pat. No. 5,649,463. It is also known that an output conveyor below the blade can be shifted laterally to accomplish a laterally shingled draft. Such an arrangement is disclosed in EP 0634325B1.

The present inventors have recognized that it would be advantageous to provide a system that could be used to slice and shingle a loaf, the loaf having an oblong or rectangular cross section with a predominant dimension, along an axis of the predominant dimension, wherein opposite long sides of the loaf, corresponding to the predominant dimension, are engaged by the conveyors of the loaf feed. The inventors have recognized that this results in a more compact packaging arrangement for a shingled draft while ensuring a more effective gripping and driving of the loaf by the conveyors of the loaf feed during slicing.

The present inventors have recognized that it would be desirable to provide a control system that allows for a predetermined draft width to be maintained, despite variation in the lateral dimension of the loaf being cut.

SUMMARY OF THE INVENTION

The invention provides a slicing and conveying system that includes a slicing blade that cuts slices from a loaf, and an output conveyor located below the slicing blade for receiving the slices and forming a shingled draft. According to the invention, a control system automatically adjusts a lateral movement of the output conveyor to form a laterally shingled draft of a consistent width in response to a sensed lateral dimension of the loaf being sliced.

According to one embodiment of the invention, a loaf feed is arranged to deliver a loaf end into a cutting plane. A blade is operable to slice the loaf in the cutting plane. A guide assembly has two relatively movable space-defining parts that define an adjustable lateral space that is adjacent to the cutting plane. The lateral space guides the loaf into the cutting plane. The lateral space is adjustable in size by movement of the space-defining parts in the lateral direction. A displacement sensor is mounted to be moved by at least one of the space-defining parts. An output conveyor is located below the loaf at the cutting plane to receive slices from the loaf. The output conveyor is circulated to transport the slices longitudinally and is also movable laterally to laterally displace a slice relative to another slice within the draft to create a laterally shingled draft. A control includes a control output that is signal-connected to the output conveyor to control the speed of the lateral movement of the output conveyor. The control has a control input that is signal-connected to the displacement sensor. The control is configured to automatically adjust the lateral displacement of the output conveyor to maintain a consistent lateral dimension of the draft given a varying lateral dimension of the loaf.

According to another aspect of the invention, the output conveyor is circulated by the control in the longitudinal direction to shingle the draft longitudinally.

According to a further aspect of the invention, a length sensor is provided to determine a length of the draft in the longitudinal direction, and wherein the lateral shingling and the longitudinal shingling are controlled by the control to maintain a controlled two dimensional footprint of the draft.

According to a further aspect of the invention, the output conveyor comprises a first precisely controllable motor to circulate the conveyor, and a second precisely controllable motor to laterally shift the output conveyor, the first and second precisely controllable motors being signal-connected to the control.

According to a further aspect of the invention, the length sensor comprises an optical sensor arranged to sense the presence of a draft moving on the output conveyor past the optical sensor, and the control times the duration of the presence of the draft sensed by the optical sensor, the control having as a further input the speed of circulation of the conveyor. The control calculates length by multiplying the duration by the conveyor speed.

According to a further aspect of the invention, the guide assembly comprises two laterally moving parts and one stationary part, the loaf being arranged between the two laterally moving parts. Each of the laterally moving parts comprises a displacement sensor that is signal-connected to the control, the laterally moving parts moving together or apart to adjust to varying loaf lateral dimension while maintaining a constant loaf vertical center-plane.

Numerous other advantages and features of the present invention will be become readily apparent from the following detailed description of the invention and the embodiments thereof, from the claims and from the accompanying drawings.

DETAILED DESCRIPTION OF THE PREFERRED EMBODIMENTS

Figure 1:
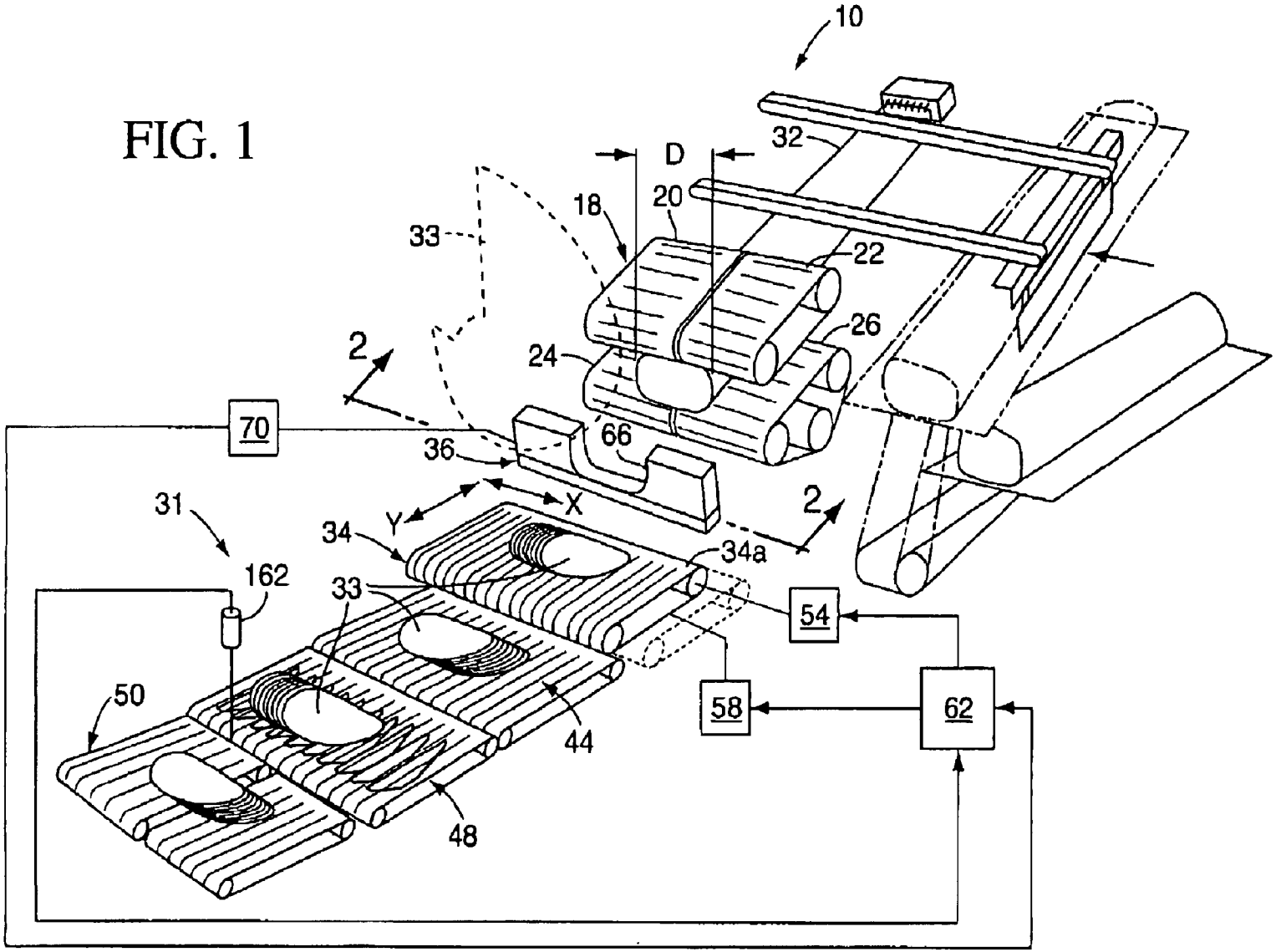
FIG. 1 is a schematical, perspective view of a slicing and conveying system of the invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates a slicing and conveying system 10 of the invention. The system is a modification of the system described in U.S. Pat. No. 5,649,463, herein incorporated by reference. The system 10 includes a loaf feed 18 that includes upper conveyors 20, 22 and lower conveyors 24, 26. The conveyor pairs 20, 24 and 22, 26 can be operated independently when two loaves are cut simultaneously. In the illustrated embodiment, the conveyors 20, 22, 24, 26 are driven at the same speed to feed a single loaf 32 through a loaf guide assembly 36, sometimes referred to as a "shear edge member," and into a cutting plane defined by a rotating blade 33.

The loaf 32 illustrated is oblong or rectangular in cross section with a predominant dimension D oriented horizontally. It is advantageous to orient the loaf 32 in this way such that more loaf surface area is engaged by the conveyors 20, 22, 24, 26 to increase the gripping of the loaf by the conveyors.

Slices cut from the loaf 32 are accumulated on an output conveyor 31 in a shingled draft 33. The output conveyor 31 can comprise a jump conveyor 34, a transfer conveyor 44, a check weight conveyor 48 and a split reject conveyor 50. The jump conveyor 34 is moved by a precisely controllable circulation motor 54 and a precisely controllable lateral movement motor 58. A control 62, such as a computer or other microprocessor, is signal-connected to the motors 54, 58. The motors 54, 58 can be servomotors driven by servomotor drives which are precisely controlled by the control 62.

A conveying surface 34*a* of the jump conveyor 34 can be controllably moved along both the X and Y axes. The jump conveyor can be configured in accordance with the embodiments described in pending U.S. application Ser. No. 10/072,338, filed Feb. 7, 2002, herein incorporated by reference. The jump conveyor can also be moved vertically to ensure a consistent drop distance of the slices as they are accumulated, as described in U.S. Pat. No. 5,649,463, herein incorporated by reference.

For laterally shingling the draft, the jump conveyor is moved laterally along the X direction as the slices are accumulated in a shingled draft. For a one dimensional shingling as shown in FIG. 1, the conveyor is not circulated longitudinally during slice accumulation. Alternating drafts are shingled in opposite directions along the X axis. Under control of the control 62, the jump conveyor first moves one direction along the X axis to accumulate a shingled draft. The jump conveyor is then circulated longitudinally to move that shingled draft onto the conveyor 44. The jump conveyor then stops circulating and moves in an opposite direction along the X axis to shingle the next draft, shingled in an opposite direction to the previous draft.

The loaf guide assembly 36 includes a laterally adjustable space, shown in the form of an open channel 66, which is automatically moved to closely conform to the lateral dimension of the loaf 32. A displacement sensor 70 provides a lateral dimension signal to the control 62. The sensor 70 can be a coil within a magnetic field or any other type of known displacement sensor.

Figure 2:
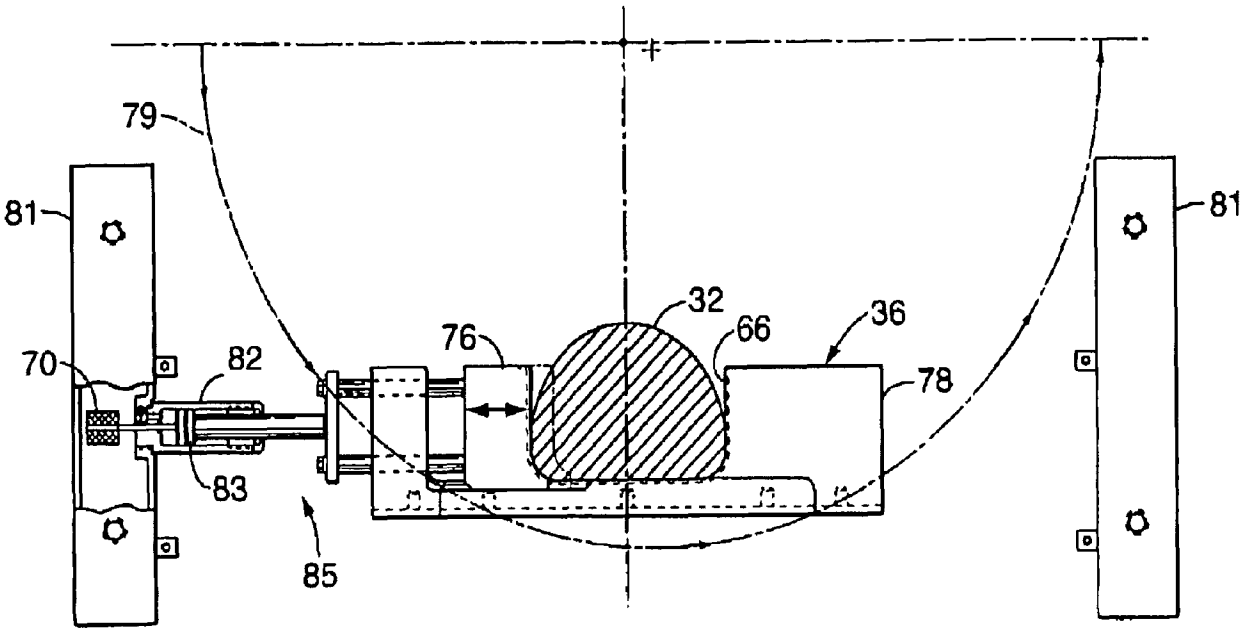
FIG. 2 is a schematical sectional view taken generally along line 22 of FIG. 1.

FIG. 2 illustrates the loaf guide assembly 36 having a first member 76 slidingly attached to a stationary second member 78. A cutting path 79 of the blade 33 is shown. A clamping cylinder 82, mounted on slicing machine structure 81, exerts a constant, pneumatically-induced lateral force F on a piston 83 which acts through a pusher assembly 85 to constrict the channel 66 by moving the members 76, 78 together. The members 76, 78 are moved apart by force from a loaf 32 when its lateral dimension increases. The displacement sensor 70 is fixed to the piston 83 within the cylinder 82.

The loaf guide assembly 36 can be a shear edge member as described in U.S. Pat. No. 5,649,463, herein incorporated by reference, but including the laterally adjustable channel 66 which is automatically moved to closely conform to the lateral dimension of the loaf 32.

Although the illustrated loaf guide assembly 36 illustrates the laterally adjustable space in the form of an open channel 66, the invention also encompasses a fully surrounding, adjustable orifice such as described in U.S. Pat. Nos. 5,974,925 or 4,428,263, or as described in pending U.S. application Ser. No. 10/162,431, filed Jun. 4, 2002, herein incorporated by reference.

Figure 3:
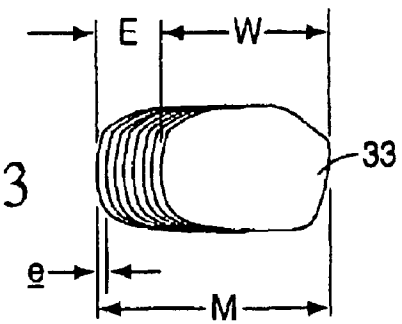
FIG. 3 is a plan view of a shingled draft.

FIG. 3 illustrates a shingled draft of slices having a slice width W and a lateral dimension or footprint M. The difference between the footprint M and the slice width W is the exposure E which is equal to the cumulative individual exposure distances e of the slices.

Figure 4:
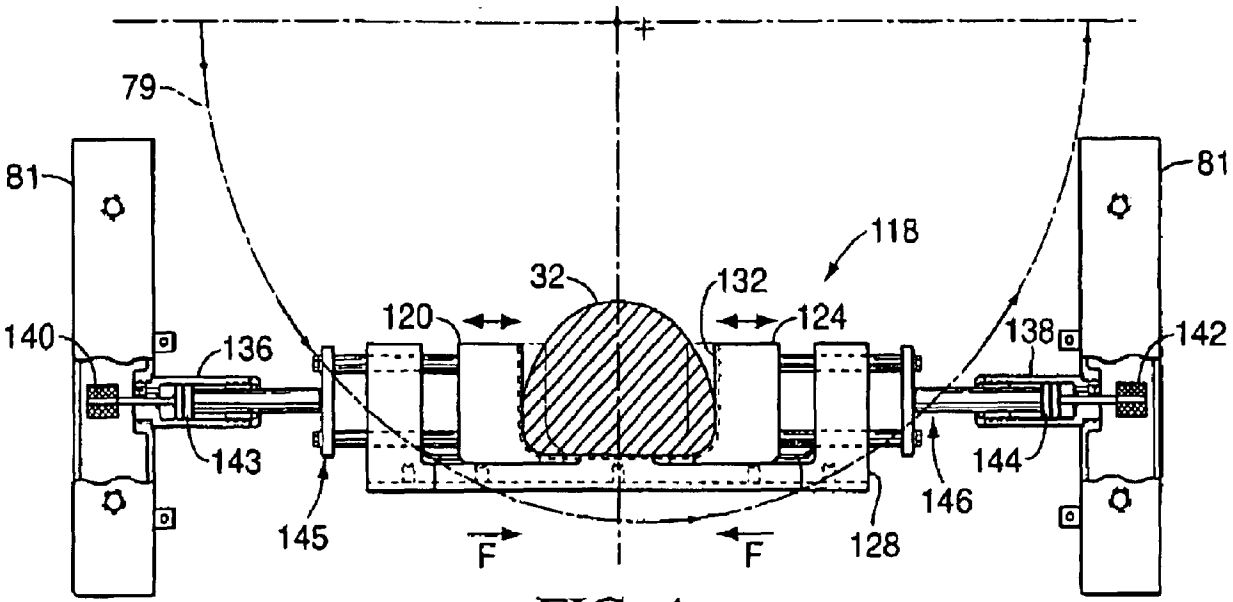
FIG. 4 is a schematical sectional view of an alternate embodiment.

FIG. 4 illustrates an alternate loaf guide assembly 118 having two moving parts 120, 124 that are slidably mounted on a stationary part 128. The parts 120, 124 are slidable together or apart to adjustably define a space, illustrated in the form of an open channel 132, which closely conforms to the lateral dimension of the loaf 32. The provision of dual movable parts 120, 124 allows for lateral dimension adjustment while maintaining a constant centerline of the loaf.

The channel assembly 118 can be a shear edge member as described in U.S. Pat. No. 5,649,463, herein incorporated by reference, but including the laterally adjustable channel 132 which is automatically moved to closely conform to the lateral dimension of the loaf 32.

Although the illustrated assembly 118 illustrates the laterally adjustable space in the form of an open channel 132, the invention also encompasses a fully surrounding, adjustable orifice such as described in U.S. Pat. Nos. 5,974,925 or 4,428,263, or as described in pending U.S. application Ser. No. 10/162,431, filed Jun. 4, 2002, herein incorporated by reference.

The parts 120, 124 are biased together by cylinders 136, 138 acting through pistons 143,144 respectively, to exert a constant, pneumatically-induced lateral inward force F on the loaf 32. The cylinders are mounted on the slicing machine structure 81. The pistons 143, 144 act through pusher assemblies 145, 146 to bias the parts 120, 124. Displacement sensors 140, 142, connected to the pistons 143, 144, respectively, within the cylinders, are signal-connected to the control 62. The sensors 140, 142 each can be a coil within a magnetic field or any other type of known displacement sensor.

The displacement sensors 70 or 140, 142, by communicating their precise position, communicate the lateral dimension of the loaf 32 to the control 62. The control then sets the lateral speed of the conveyor 34, along the X axis, by adjusting the speed of the motor 58 during slicing, to shingle the slices at a controlled rate to achieve the pre-selected lateral dimension, or footprint M of the draft. The mathematical relationship between the lateral dimension of the loaf and the lateral speed of the conveyor during slicing is pre-determined and programmed into the control. The target lateral dimension M of the draft is equal to the total exposure E plus the slice width W of the last slice of the draft. If the slice width decreases, a faster conveyor speed initiated by the control 62 creates a greater exposure E to maintain the target draft footprint M. If the slice width increases, a slower conveyor speed initiated by the control 62 creates a lesser exposure E to maintain the target draft footprint M.

Figure 5:
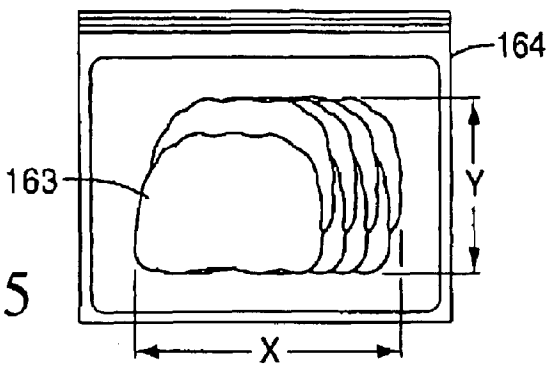
FIG. 5 is a plan view of a draft shingled along the X axis and shuffled along the Y axis.

As illustrated in FIG. 5, a draft 163 can be shingled in the lateral direction X as described above and shuffled or shingled in the longitudinal direction Y creating a pre-selected two-dimensional footprint in the plane that includes the X and Y axes. To shuffle the draft in the longitudinal direction, the jump conveyor 34 is alternately circulated in forward and reverse directions during slice accumulation. The extent of longitudinal shuffling can be automatically adjusted to correct the length of the draft to compensate for varying height of the loaf as described below, using a length sensor. The draft 163 is illustrated in a reclosable pouch 164.

Figure 6:
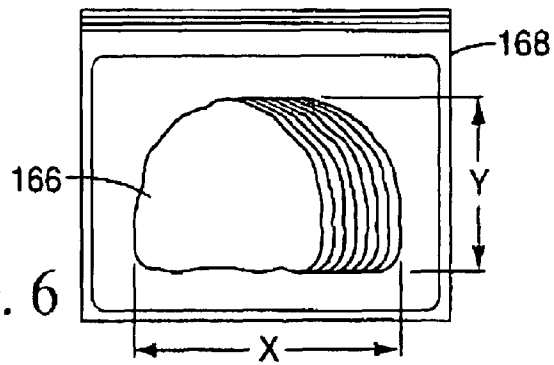
FIG. 6 is a plan view of a draft shingled along both the X and Y axes.

As illustrated in FIG. 6, a draft 166 can be shingled along the lateral direction X as described above, and shingled along the longitudinal direction Y, creating a pre-selected two-dimensional footprint in the plane that includes the X and Y axes. To shingle the draft in the longitudinal direction, the jump conveyor 34 is circulated in the forward direction during slice accumulation. The rate of longitudinal shingling is automatically adjusted to correct the length of the draft to compensate for varying height of the loaf as described below, using a length sensor. The draft 166 is illustrated in a reclosable pouch 168.

For two dimensional footprints, a length sensor, such as an optical sensor 162 (shown in FIG. 1), can be used to measure and adjust the longitudinal length of the draft. Using the optical sensor 162, the longitudinal length of the draft is determined by sensing the presence of the draft on the conveyor as it passes by the sensor, and timing that presence. Given that the precise speed of the conveyor 48 is an input to the control 62, the length of the draft is calculated by the control as the conveyor speed multiplied by the length of time the sensor senses the presence of the draft.

The optical sensor 162 can be a photo eye with integrated sender and reflection-receiver. The photo eye can have its light beam directed between belts of the conveyor such that no light reflection is received until a draft is positioned beneath the light beam. The photo eye can issue an on or off switch signal that changes state when a reflection is received from the draft. These signals are communicated to the control 62 and timed by the control 62. Given that the control 62 also has the speed of the conveyor 48 as an input, the length of the combined draft can be calculated by the control 62, by multiplying conveyor speed by the time period between the sensed presence and absence of the elongated draft. For example, if the sensor "sees" product for 0.050 seconds and a known conveyor speed is 108 inches per second, then the draft length would be 5.4 inches.

Given that the control calculates the length of the draft in the longitudinal direction, the speed and direction of the motor 54 is adjusted by the control 62 to adjust a length of a subsequent shuffled or shingled draft in the longitudinal direction.

Although a lateral shingling is described above, it is also encompassed by the invention to laterally shuffle the slices by moving the jump conveyor 34 laterally back and forth. It is also encompassed by the invention to use both lateral and longitudinal movements of the jump conveyor surface 34*a* to create two dimensional patterns beyond those described above.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A slicing and conveying system comprising:

a loaf feed arranged to deliver a loaf end into a cutting plane;

a blade operable to slice said loaf in said cutting plane;

a loaf guide assembly having two relatively movable guide parts that define an adjustable space that is adjacent to said cutting plane, said space guiding said loaf into said cutting plane, said space adjustable in size by movement of at least one of said guide parts;

a displacement sensor mounted to be moved by one of said guide parts;

an output conveyor located below said loaf at said cutting plane to receive slices from said loaf, said output conveyor movable during slicing to offset a current slice from a previous slice to form a draft having a lateral dimension; and a control, said control having a control output that is signal-connected to said output conveyor to control movement of said output conveyor, said control having a control input that is signal-connected to said displacement sensor, said control configured to adjust the movement of said output conveyor to adjust the lateral dimension of said draft given a varying dimension of said loaf.

2. The system according to claim 1, wherein said two relatively movable guide parts are laterally movable and wherein said loaf guide assembly comprises an additional stationary part, the loaf arranged in said adjustable space between the two laterally movable parts, a second movement sensor mounted to be moved by a respective other one of said two guide parts, each of the laterally movable guide parts includes one of said displacement sensors that is signal-connected to the control, said laterally movable guide parts moving together or apart to adjust to a varying loaf's lateral dimension.

3. The system according to claim 1, wherein said output conveyor is moved back and forth by said control in the lateral direction to shuffle said draft.

4. The system according to claim 1, wherein said output conveyor is moved in one lateral direction by said control to shingle said draft.

5. The system according to claim 1, wherein said movement of said output conveyor is in the lateral direction;

wherein said output conveyor is circulated by said control in the longitudinal direction to offset each subsequent slice from a previous slice of said draft longitudinally an offset distance;

comprising a length sensor, said length sensor configured for obtaining a length in the longitudinal direction of said draft, and wherein said movement of said conveyor and said offset distances are controlled by said control to maintain a consistent two dimensional footprint of said draft.

6. The system according to claim 5, wherein said output conveyor comprises a first precisely controllable motor to circulate said conveyor, and a second precisely controllable motor to laterally shift said output conveyor, controllable motors being signal-connected to said control.

7. The system according to claim 1, wherein said output conveyor is configured to move laterally in a first direction to shingle a first draft of slices from said loaf, and to move laterally in a second, opposite direction to shingle a second draft of slices from said loaf.

8. The system according to claim 7, wherein said output conveyor is circulated by said control in the longitudinal direction to also shingle both said first and second drafts in the longitudinal direction.

9. The system according to claim 7, wherein said output conveyor is circulated by said control in opposite longitudinal directions to shuffle both drafts in the longitudinal direction.

10. The system according to claim 1, wherein said movement of said output conveyor is in the lateral direction, and wherein said output conveyor is circulated by said control in opposite longitudinal directions to shuffle said draft longitudinally.

11. The system according to claim 10, wherein said output conveyor is moved back and forth by said control in the lateral direction to shuffle said draft.

12. The system according to claim 10, wherein said output conveyor is moved in one lateral direction by said control to shingle said draft.

13. The system according to claim 1, wherein said movement of said output conveyor is in the lateral direction.

14. The system according to claim 13, wherein said output conveyor is circulated by said control in the longitudinal direction to shingle said draft longitudinally.

15. The system according to claim 14, wherein said output conveyor is in one lateral direction by said control to shingle said draft.

16. The system according to claim 14, comprising a length sensor, said length sensor configured for obtaining a length in the longitudinal direction of said draft, and wherein said movement of said conveyor and said longitudinal shingling are controlled by said control to maintain a consistent two dimensional footprint of said draft.

17. The system according to claim 16, wherein said output conveyor comprises a first precisely controllable motor to circulate said conveyor, and a second precisely controllable motor to laterally shift said output conveyor, said first and second precisely controllable motors being signal-connected to said control.

18. The system according to claim 16, wherein said length sensor comprises an optical sensor arranged to sense the presence and absence of a draft moving on the output conveyor past the optical sensor, and said control times the duration of the presence of the draft sensed by the optical sensor, said control having as a further input the speed of circulation of the conveyor.

19. A slicing and conveying system comprising:

a loaf feed arranged to deliver a loaf end into a cutting plane;

a blade operable to slice said loaf in said cutting plane;

a loaf guide assembly having two relatively movable guide parts that define an adjustable lateral space that is adjacent to said cutting plane, said lateral space guiding said loaf into said cutting plane, said lateral space adjustable in size by movement of at least one of said guide parts in the lateral direction;

a displacement sensor mounted to be moved by one of said guide parts;

an output conveyor located below said loaf at said culling plane to receive slices from said loaf, said output conveyor circulated to transport said slices longitudinally and also moved laterally to laterally displace a slice relative to another slice within said draft to laterally shingle said draft; and a control, said control having a control output that is signal-connected to said output conveyor to control the speed of the lateral movement of said output conveyor, said control having a control input that is signal-connected to said displacement sensor, said control configured to adjust the lateral displacement of said output conveyor to maintain a consistent lateral dimension of said draft given a varying lateral dimension of said loaf.

20. The system according to claim 19, wherein said output conveyor comprises a first precisely controllable motor to circulate said conveyor, and a second precisely controllable motor to laterally shift said output conveyor, said first and second precisely controllable motors being signal-connected to said control.

21. The system according to claim 19, wherein said two relatively movable guide parts are laterally movable and wherein said loaf guide assembly comprises an additional stationary part, the loaf arranged in said adjustable space between the two laterally movable parts, a second movement sensor mounted to be moved by a respective other one of said two guide parts, each of the laterally movable guide parts includes one of said displacement sensors that is signal-connected to the control, said laterally movable guide parts moving together or apart to adjust to a varying loaf's lateral dimension.

22. The system according to claim 19, wherein said output conveyor is configured to move laterally in a first direction to shingle a first draft of slices from said loaf, and to move laterally in a second, opposite direction to shingle a second draft of slices from said loaf.

23. The system according to claim 22, wherein said output conveyor is circulated by said control in the longitudinal direction to also shingle both said first and second drafts in the longitudinal direction.

24. The system according to claim 22, wherein said output conveyor is circulated by said control in opposite longitudinal directions to shuffle both drafts in the longitudinal direction.

25. The system according to claim 19, wherein said output conveyor is circulated by said control in the longitudinal direction to shingle said draft longitudinally.

26. The system according to claim 25, comprising a length sensor, said length sensor configured for obtaining a length in the longitudinal direction of said draft, and wherein said lateral shingling and said longitudinal shingling are controlled by said control to maintain a consistent two dimensional footprint of said draft.

27. The system according to claim 26, wherein said length sensor comprises an optical sensor arranged to sense the presence and absence of a draft moving on the output conveyor past the optical sensor, and said control times the duration of the presence of the draft sensed by the optical sensor, said control having as a further input the speed of circulation of the conveyor.

* * * * *

UNITED STATES PATENT AND TRADEMARK OFFICE

CERTIFICATE OF CORRECTION

PATENT NO. : 6,935,215 B2
APPLICATION NO. : 10/218967
DATED : August 30, 2005
INVENTOR(S) : Scott A. Lindee and Glenn Sandberg It is certified that error appears in the above-identified patent and that said Letters Patent is hereby corrected as shown below:

column 7, line 50, change “culling” to --cutting--.

Signed and Sealed this

Fifteenth Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 6,935,215 B2
APPLICATION NO. : 10/218967
DATED : August 30, 2005
INVENTOR(S) : Scott A. Lindee and Glenn Sandberg It is certified that error appears in the above-identified patent and that said Letters Patent is hereby corrected as shown below:

At column 7, line 50, change “culling” to --cutting--.

Signed and Sealed this

Thirtieth Day of October, 2007

JON W. DUDAS
*Director of the United States Patent and Trademark Office*